United States Patent [19]

Jensen et al.

[11] Patent Number: 4,801,784

[45] Date of Patent: Jan. 31, 1989

[54] ELECTRICAL DEVICE COMPRISING A PTC OR NTC COMPOSITION

[75] Inventors: Michael L. Jensen, Overijse; Jean-Marie E. Nolf, Hamme-Mille; Jan Vansant, Louvain, all of Belgium

[73] Assignee: N.V. Raychem S.A., Kessel-lo, Belgium

[21] Appl. No.: 18,229

[22] Filed: Feb. 24, 1987

[30] Foreign Application Priority Data

Feb. 24, 1986 [GB] United Kingdom ..... 8604519

[51] Int. Cl.[4] ..... H05B 3/10

[52] U.S. Cl. ..... 219/548; 219/544; 219/553; 338/22 R

[58] Field of Search ..... 219/553, 544, 549, 548; 338/22 R, 22 SD

[56] References Cited

U.S. PATENT DOCUMENTS

| | | | |
|---|---|---|---|
| 4,314,145 | 2/1982 | Horsma | 219/553 |
| 4,330,703 | 5/1982 | Horsma et al. | 338/22 R X |
| 4,330,704 | 5/1982 | Jensen | 219/553 |
| 4,331,860 | 5/1982 | Roller et al. | 338/22 R X |
| 4,334,148 | 6/1982 | Kampe | 219/553 |
| 4,341,949 | 7/1982 | Steiner et al. | 338/22 R X |
| 4,475,138 | 10/1982 | Middleman et al. | 338/22 R |
| 4,574,188 | 3/1986 | Midgley | 219/549 |
| 4,654,511 | 3/1987 | Horsma et al. | 219/548 |
| 4,659,913 | 4/1987 | Midgley | 219/549 |

FOREIGN PATENT DOCUMENTS

| | | |
|---|---|---|
| 0158410 | 10/1985 | European Pat. Off. . |
| 1529353 | 10/1978 | United Kingdom . |
| 1562085 | 3/1980 | United Kingdom . |

*Primary Examiner*—E. A. Goldberg
*Assistant Examiner*—Marvin M. Lateef
*Attorney, Agent, or Firm*—Timothy H. P. Richardson; Herbert G. Burkard

[57] ABSTRACT

A self-regulating PTC heater in which the direction of flow of current is reversible in a region of the PTC material in response to a change in the resistivity of the material whereby current in-rush is reduced.

16 Claims, 11 Drawing Sheets

PRIOR ART

ELECTRICAL DEVICE COMPRISING A PTC OR NTC COMPOSITION

BACKGROUND OF THE INVENTION

This invention relates to an electrical device a property of which is a function of its temperature. In particular it relates to the use of such a device as a heater, particularly one that is self-regulating with respect to temperature. The device is particularly useful in the telecommunications, power, electrical and process industries, for example for activating sealing materials or causing heat-recovery of cable accessories or for trace heating.

The invention will be described primarily in terms of conductive polymer compositions, especially those containing a conductive filler rendering a base polymer conductive, and in terms of devices exhibiting positive temperature coefficient of resistance (PTC) behaviour. However it is to be understood that the invention is applicable to other materials, such as ceramics and inherently conductive materials, and to materials exhibiting other types of dependence on temperature, for example a negative temperature coefficient of resistance (NTC).

In designing devices having some property that is a function of temperature we have noticed that difficulties may arise in achieving the desired relationship between temperature and the variable concerned. This difficulty tends to occur particularly if one attempts to rely solely on the variation of some materials property with temperature. A PTC conductive polymer device will be described to illustrate this problem, and to explain a prior art solution.

PTC conductive polymer devices have been used for many years as heaters, particularly in tape form for trace heating: they may be wound around pipework in the process industry to maintain a certain temperature thus ensuring correct flow rates and preventing salting out. PTC materials automatically self-regulate their temperature thus avoiding the need for thermostats or fuses etc.

The distinguishing characteristic of PTC materials, therefore, is that on attaining a certain temperature, a substantial rise in resistance occurs. They exhibit a more or less sharp rise in resistance within a narrow temperature range, but below that temperature range exhibit only relatively small changes in resistance with temperature. The temperature or range at which the resistance commences to rise sharply is often designated the switching or anomaly temperature ($T_s$) since on reaching that temperature the heater exhibits an anomalous change in resistance, and for practical purposes switches off.

A widely used PTC material is doped barium titanate which has been used for self-regulating ceramic heaters employed in such applications as food warming trays and other small portable appliances. Polymeric PTC materials are also known, as they generally comprise one or more conductive fillers such as carbon black or powdered metal dispersed in a crystalline thermoplastic polymer. PTC compositions prepared from highly crystalline polymers generally exhibit a steep rise in resistance commencing a few degrees below their crystalline melting points, similar to the behaviour of their ceramic counterparts at the curie temperature. PTC compositions derived from polymers and copolymers of lower crystallinity, for example less than about 50% exhibit somewhat less steep increases in resistance, which increase commences at a less well defined temperature in a range often considerably below the polymer's crystalline melting points. In the extreme case some polymers of low crystallinity yield resistance temperature curves which are more or less convex upwards. In addition to the effect of the polymeric material, one should also consider the type and amount of conductive filler. Particularly in the case of carbon black, one should consider its particle size, shape, surface characteristics, tendency to agglomerate and the shape of the agglomerates (i.e. its tendency to structure).

In the case of most prior art PTC materials, one sees a relatively constant wattage (CW) output below the switching temperature of range ($T_s$). The resistance (R) at temperatures below $T_s$ is relatively low and constant and thus the current flow is relatively high for any given applied voltage E ($I=E/R$). The power generated by this current flow may be dissipated as Joule heat, i.e. heat generated by electrical resistance. This power, which is given by $E^2/R$, will heat the PTC material. The resistance stays at this relatively low level until about $T_s$, at which point a rapid rise in resistance occurs. With the rise in resistance there is a concomitant decrease in power, thereby limiting the amount of heat generated so when $T_s$ is reached heating is essentially stopped. Then upon a lowering of the temperature of the device below $T_s$ by dissipation of heat to the surroundings, the resistance drops, thereby increasing the power output.

At a steady state, therefore, the heat generated will essentially balance the heat dissipated. Heat output is automatically regulated to maintain a temperature of about $T_s$.

DESCRIPTION OF RELATED ART

Kohler, U.S. Pat. No. 3,243,753, discloses carbon filled polyethylene wherein the conductive carbon particles are in substantial contact with one another. Kohler contemplates a product containing 40% polyethylene and 60% carbon particles so as to give a resistance at room temperature of about 1 ohm per 2.5 cms. As is typical of the performance of such materials, a relatively flat resistance temperature curve at low temperatures is followed by a sharp rise in resistivity of at least 250% over a 13 centigrade degrees range. A suggested mechanism for the sharp rise in resistivity is that such change is a function of the difference in thermal expansion of the polyethylene and particulate carbon. A high carbon content, such as 60%, forms a conductive network through the polyethylene polymer matrix, thereby giving an initially constant resistance at low temperatures. However, at about the crystalline melting point of the polymer, the polymer matrix rapidly expands, such expansion causing a break-up of much of the conductive network, which in turn results in a sharp increase in the resistance of the composition.

Other theories have been proposed to explain PTC behaviour, including complex mechanisms based on electron tunnelling through inter-carbon grain gaps, and some mechanism based upon a phase change from crystalline to amorphous in the matrix. A background discussion of a number of proposed alternative mechanisms for the PTC phenomenon is to be found in "Glass Transition Temperatures as a Guide to the Selection of Polymers suitable for PTC materials", J. Meyer, Polymer Engineering and Science, November 1973 Volume 13 No. 6.

Such PTC materials have found wide use as heaters, particularly in strip form for use around pipework in the process industries. The heaters may be flexible, cheap and easy to install. We have however noted a difficulty, as mentioned above, of achieving certain desired relationships between temperature and power output.

The reason for this difficulty is as follows. A material having a $T_s$ say, at substantially about 100° C. may have a resistance at $T_s$ as much as 10 times or more its resistance at ambient temperatures. Since the PTC material will normally function at or slightly below $T_s$, its effective heat output is determined by its resistance slightly below $T_s$. Therefore, a PTC material drawing what is needed, for example 15 amps, at 200° C. could easily draw 150 amps at ambient temperature. Such a heater would require a current carrying capacity vastly in excess of that required for steady state operation, or alternatively require the installation of complex and generally fragile or expensive control circuitry to prevent the initial 150 amps current inrush from burning out the material or lead wires when the material is first connected to an electrical power source.

A prior art solution to this problem is disclosed in Horsma et al., U.S. Pat. No. 4,330,703. This solution is a self regulating electrical heating article adapted for connection to a source of electrical power, comprising a first layer of material, said first layer exhibiting a positive temperature coefficient of resistance with an associated anomaly temperature $T_s$ and having at least partially contiguous therewith a second layer of constant wattage material having an associated resistance, said article being connectable to an electric power input source whereby current power through at least a portion of said first layer and through at least portion of said second layer, whereby there is both direct electrical and thermal coupling between said first and second layers, and whereby at a temperature which is the higher of the temperature at which the resistance of said first layer exceeds the resistance of said second layer or the anomaly temperature of said first layer, current flow predominantly follows the directionally shortest path through said first layer.

Significant benefits result from the above layers approach. For example the problem of current in-rush outlined above may be reduced and overcome in many instances, and also hot-lining (generation of heat in a thin band between the electrode reducing heat output and resulting in premature switching off) may also be overcome.

Work by the present inventors has, however, revealed some disadvantages in the layers approach. For example some difficulties may be experienced under unfavourable conditions in laminating together the first and second layers to produce a good electrical and thermal connection between them. Also, some particular values of resistance of the overall heating article may be difficult to achieve. The reason is that layers of constant wattage materials may be desired that are quite thin and in order to achieve the desired resistance through their thickness, resistivities are required that are difficult to produce reliably in the case of carbon loaded polymers. This is because the resistivity of the polymer may be a very high order function of its carbon concentration.

Thus, the idea of achieving a certain property of electrical device by employing two or more different materials of different properties through both of which the current may pass, whilst successful in many fields, has its limitations. This applies not only to resistance, and hence heating power output, but also to other properties as a function of temperature.

SUMMARY OF THE INVENTION

What we have now discovered is a way of altering the way in which a certain property varies with temperature. We do it by altering, as a function of temperature, the path through a material that the current takes. Small alterations of current path are, of course, known although not to our extent, for our purpose, or having our effect.

Thus, the present invention provides an electrical device which comprises:

(a) a material comprising a PTC or NTC composition;

(b) at least two electrodes to which a source of electrical power may be applied to cause current to flow through the material; and (c) means, other than reversal of polarity of the source of power, whereby a direction of current flow in a region of the material may be made to alter through at least 90° and preferably through substantially 180°.

The means (c) that causes preferably a substantially 180° change in the current flow does not include reversal of the polarity of the power source. Thus, we are not concerned with, and the invention does not include, current reversals that occur solely through the use, for example, of an AC power source. The device of the invention may, however, be powered by an AC power source but it will have some other means that alters the direction of the current flow.

We prefer that the alteration of the direction of current flow occurs automatically as a function of temperature, more preferably as a result of the change of resistivity of the PTC or NTC composition.

In general, we prefer that the change in current direction results in a change in the length of the current path. Alternatively or additionally it may result in passage of current through a different material (different that is as regards the property of interest).

For example, to take the case of a PTC heater otherwise susceptible to current in-rush on initial connection to a power source, the current path may be initially long and after the resistance has increased through an increase in temperature, the current path may be short. What the invention does therefore is achieve the desired resistance temperature function by (if necessary) accepting an unacceptable resistivity temperature function and altering the length of the current path as a function of temperature.

Thus, when the device is below $T_s$ and its resistivity is low, an excessive current is avoided due to a long current path, i.e. the overall resistance of the device is not unacceptably low. Power is generated in the device and in consequence it heats up. Heat will be lost to the surroundings, particularly if the device is used as a heater, and it will continue to heat until the power generated in it ($E^2/R$) equals the rate at which heat is lost to the surroundings. If the device did not exhibit PTC behaviour and no other temperature control were employed the final temperature reached would depend solely on the surroundings, is on the extent to which the device and the article to be heated were thermally insulated.

The power output of a PTC device, however, falls off at a certain preselected temperature, $T_s$ ($E^2/R$ decreases due to an increase in R). For successful self-regulation of temperature under a variety of conditions two things are necessary. Firstly, the device must be able to heat an article if its temperature falls below $T_s$: i.e. power output below $T_s$ must be greater than the rate at which heat is lost to the surroundings in the case of worst insulation, and this requires a value of R below a certain value. Secondly, above $T_s$ power output must be no larger than the rate at which heat is lost in the case of best insulation, and this requires a value of R above a certain value. If the extent of insulation of the article to be heated is uncertain or likely to vary (and it is under just those circumstances that self-regulation is desirable) then it will be necessary that the high and low values of R be widely separated. What one wants is a sharp and large increase in resistivity at $T_s$.

An ideal situation for many purposes would be a low value of R just high enough to restrict the current to values that the device and power supply can stand efficiently, a high value infinitely high, and a value just below $T_s$ where most heat is generated that is low enough to get the heating job done as quickly as possible. In the above discussion of the prior art it was noted, unfortunately, that a reasonable heating capacity may result in an excessive in-rush current on initial connection to the source of electrical power. The solution proposed was to add a layer of constant wattage (CW) material. This, however, increases both the low and high resistances by the same amount, and therefore reduces the ratio between them. For many purposes the ratio remains sufficiently large but there are occasions where the technique of the present invention may be preferred. In the present invention the ratio between the high and low values of resistivity (the autotherm height) will in general remain unaltered. This is because the current may pass solely through one and the same PTC material.

In the above discussion we were concerned with reducing the current path length as temperature increases in order to reduce current in-rush but to retain a satisfactorily high power output after the resistivity of the material has increased towards the value at $T_s$.

The present invention, therefore, also provides an electrical device which comprises:

(a) a material comprising a PTC or NTC composition;

(b) at least two electrodes to which a source of electrical power may be applied to cause current to flow through the material; and (c) means whereby a current path length through the material may be reduced as the temperature of the device increases.

We prefer that the reduction occurs automatically as a function of temperature, more preferably as a result of the change of resistivity of the PTC or NTC composition.

The current path length preferably is reduced by reason of at least a part of it altering direction by at least 90°, preferably substantially 180°.

One way of achieving an alteration in the direction of current flow is to employ a device which, notionally at least, comprises two or more, for example three, electrical zones. Preferred embodiments of the invention employing zones will be described below in connection with the drawings, but the following passage is in more general terms. The current direction through one or more zones may alter, for example reverse, whilst the current direction in the other zones remains substantially constant. Alternatively, the current path in each of the zones may alter. The zones may function effectively independently; and may be physically separated and/or thermally separated from one another, being interconnected only by, for example, an electrical connection. In another embodiment the zones may be physically adjacent, and optionally in thermal contact, so there is a plurality of available current paths from one zone to another. The plurality of available current paths may result from each zone having two (or more) electrodes to which power may be applied to cause current to flow through that zone. The way in which power is connected to the electrodes may be varied as a function of temperature of the device. This variation may result from a variation in the way in which the electrodes of the various zones are interconnected. The variation in the interconnections between the electrodes may occur within the device, as is presently preferred, or it may occur for example through simple switches. There is, however, another way in which current may pass from one zone to another. Instead of or in addition to current passing from one zone to another via an electrode or other interconnection, it may pass directly between the material of adjacent zones. For example the device may be in the form of a strip comprising three zones running along the strip with the zones side-by-side. Electrodes for the zones may be provided on the top and bottom surfaces of the strip, again running along its length. The predominant current paths may be perpendicularly through the thickness of the strip from one electrode to the other. However there may also be some diagonal current flow from, say, the top electrode of one zone to the bottom electrode of another zone. We prefer however that such diagonal current is small and more preferably that it does not occur. This can be achieved in general by choosing the relative dimensions of the device, in the case of a strip device by a width that greatly exceeds its thickness.

One way in which current flow through the zones may alter is for interconnection of the zones to vary between series interconnection and parallel interconnection, preferably from series to parallel as the temperature of the device increases.

Thus, the invention further provides an electrical device which comprises:

(a) a material comprising a PTC or NTC composition;

(b) at least two electrodes to which a source of electrical power may be applied to cause current to flow through the material;

(c) at least two zones through which current may pass; and (d) means whereby interconnection of the zones with respect to the source of electrical power may be altered between series and parallel.

A consequence of this alteration between series and parallel interconnection may be that the direction of current flow within at least one of the zones is altered, preferably at least 90° and usually substantially 180°.

We prefer that the alteration between series and parallel occurs automatically as a function of temperature, more preferably as a result of the change of resistivity of the PTC or NTC composition.

The current path may alter automatically as a direct result of the change of resistivity of the PTC or NTC composition. In this case the device will in general comprise at least two materials having resistivities that vary as different functions of temperature, for example one could employ a PTC composition and a constant wattage composition. The two materials would be arranged such that at least two current paths, different in the extent of passage through the PTC composition, are possible between at least two electrodes of the device. At low temperature, the current would flow to a greater extent through the PTC composition, and as the temperature increased (and hence also the resistivity of the PTC composition) the current would flow more and more through the constant wattage composition. This greater flow through the constant wattage composition may be at the expense of flow through the PTC composition, or it may merely result in a different direction of flow through at least a part of the PTC composition.

Thus various zones of an electrical device, each comprising a PTC composition and provided with electrodes, may be interconnected, either by switches that may be opened or closed to alter the mode of interconnection of the zones, or by a constant wattage composition having a resistance between the low temperature and high temperature resistances of the PTC composition. When the device is cold the constant wattage interconnections may be regarded as having a high resistance (relative to that of the PTC composition of the zones), resulting in an open circuit between the relevant electrodes. Conversely, when the device is hot, the constant wattage interconnections are of relatively low resistance, and an electrical interconnection between the electrodes is provided.

We have found that such an arrangement may be used in a device having zones comprising a PTC material whose mode of interconnection can change between series and parallel; in this case electrical interconnection provided by the constant wattage material may result in a parallel circuit, and an open circuit may result in series circuit. We have also found that the in-rush current and the steady state current through the device are functions of the value of the resistance of the constant wattage interconnection. More interestingly, we have found that with increasing resistance of the interconnection, the inrush current falls earlier or more steeply than does the steady state current. There is therefore a value of the interlink resistance where the ratio between the inrush current and the steady state current is a minimum. This occurs when the interlink resistance is the geometric mean of the high and low values of the PTC resistance, although useful results may be obtained with resistances from a factor of 10 below to a factor of 10 above this value. This range of resistances may be expected to increase the above ratio by a factor of, say, 2. For comparison it may be noted that the ratio may be increased by a factor of, say, 5 if the interlink resistance is reduced to zero or increased to infinity.

The present invention therefore also provides an electrical device which comprises:

(a) a material comprising a PTC composition in at least two zones;

(b) at least two electrodes to which a source of electrical power may be applied to cause current to flow through the zones;

(c) a constant wattage composition interconnecting the two zones, the resistance of the constant wattage composition being from 0.1 to 10.0 times the geometric mean of the high and low resistances of the PTC composition.

The invention also provides an electrical device which comprises:

(a) a strip of material comprising a PTC or NTC composition;

(b) at least one elongate electrode in sheet form in electrical contact with and running along one side of the material;

(c) at least two further elongate electrodes in electrical contact with and running along the other side of the material. Preferably the said two further electrodes are separated by a distance greater than twice the thickness of the material.

It should be noted that references in the specification to constant wattage compositions denote a material whose resistance does not increase by more than a factor of 6, preferably 2, in any 30° C. segment below the $T_s$ of the PTC composition with which it is used. Preferably the constant wattage material, if used as an interlink as described above, has a resistance of 0.1 to 10, especially about 1 ohm at 25° C. It should also be noted since most PTC materials are, in effect, constant wattage material up to about their $T_s$, that the term constant wattage encompasses materials that manifest PTC characteristics provided, however, that they are used in conjunction with a PTC material having a lower $T_s$.

Devices employing an interlink between electrodes as described above may employ an NTC composition instead of the constant wattage composition, in which case the switching say from series to parallel will occur at a temperature partly determined by the resistivity-temperature characteristics of the NTC composition. Such an NTC interlink may be used in conjunction with a PTC composition or in conjunction with a constant wattage composition as the heater or other main functional part of the device.

Where reference is made to the device comprising a PTC or NTC composition, we prefer that such a composition is used alone (except of course for the electrodes and any switching or other interconnection between them). Thus, where the device is used as a heater substantially all the heat will be generated within the PTC or NTC composition. It is possible, however, for any of the embodiments of the present invention to be used in conjunction with more complex materials, for example ones comprising layers of different compositions as described in U.S. Pat. No. 4,330,703. Thus a material may comprise a layer of a PTC composition and a layer of a constant wattage composition (preferably one having a resistivity of at least 1 ohm cm, especially at least 100 ohm cm, generally 300–1000 ohm cm, at 25° C.).

A detailed description of suitable PTC compositions is not necessary since they are in general now well known in the art, and the skilled reader will be able to produce suitable compositions for his particular purpose. The following notes may however be helpful.

Most PTC materials comprise a crystalline thermoplastic matrix having a conductive, usually particulate filler dispersed therein. Kohler, U.S. Pat. No. 3,243,753 discloses a polyethylene or polypropylene carbon black composition, in which the polyolefin has been polymerized in situ, such materials exhibiting an anomaly temperature $T_s$ close to their melt temperature, i.e. about 110° C.±10° C. Likewise Kohler et al, U.S. Pat. No. 3,351,882 discloses carbon particles dispersed in polyethylene in which the composition may be cross-linked, or may contain thermosetting resins to add strength or rigidity to the system. However, the $T_s$ remains just below the crystalline melting point of the thermoplastic polyolefin. U.S. Pat. No. 3,823,217 to Kemp discloses a wide range of conductive particle filled crystalline polymers that exhibit PTC behaviour. These polymers include polyolefins such as low, medium and high density polyethylenes, polypropylene, poly (butene-1) poly (dodecamethylene pyromellitimide), ethylene propylene copolymers and terpolymers with non conjugated dienes, poly (vinylidene fluoride) and vinylidene fluoride-tetrafluoroethylene copolymers. It is also suggested that blends of polymers containing carbon black can suitably be employed such as polyethylene with an ethylene ethyl acrylate copolymer.

The devices of the invention preferably comprise heaters, in which case their power outputs preferably vary with temperature. The devices may however be used as sensors or as controls that measure temperature. In particular, an embodiment where the current path reverses as a function of temperature may be particularly useful as a sensor since a reversal of polarity of some part of the device will be easily recognizable. We expect, nonetheless, that use as heaters will be more important and the following description is of a specific use of a heater.

Heaters are required in the cable accessories and pipe protection industries in the installation of products such as cable splice cases and cable or pipe repair sleeves etc. In the past, dimensionally-recoverable articles have been used to form cases around cable splices and to repair cables. Such articles shrink significantly on heating to engage tightly the cable or other substrate to be protected. A good environmental seal results in part from the tight engagement due to the shrinking and in part from the use of a sealing material. A preferred sealing material is a hot-melt adhesive, which must of course be heated in order to install the article.

Typically, such articles comprise wrap-around sleeves for example such as that described in Ellis, U.S. Pat. No. 3,455,336. The sleeve is wrapped around a cable splice and held in a wrapped around configuration by a closure channel that holds together opposing longitudinal edges of the sleeve. The sleeve may be coated on its internal surface with a hot-melt adhesive. A single heating step will cause the sleeve to shrink into engagement with the cable splice and the adhesive to become activated. Heating in the past has been carried out using a propane torch.

There are many instances where the use of a propane torch is undesirable or impossible. For example, if a torch is to be used to install a repair sleeve on a gas pipe or on cables running in the same conduits as gas pipes it may be necessary to shut down the gas pipe whilst work is carried out. Also, in confined spaces, use of a torch may be dangerous or difficult.

The device of the present invention may be used instead of a torch in the installation of cable accessories or pipe or other repair products. For example it may be used to activate a hot-melt adhesive or other heat-activatable sealing material, and/or it may be used to cause heat-recovery of a dimensionally recoverable article.

We particularly prefer to use the device of the invention in conjunction with any of the following: an article that can be installed around a substrate, especially an elongate substrate such as a cable or cable splice; an article that is non-recoverable; an article that is flexible; an article that has a heat-activatable sealing material localized such as to produce a sealed seam between the substrate and the article and between any two surfaces of the article where otherwise there would be a leak path; and an article having means for displacing activated sealing material into any voids. Any two or more of these features may be used together, and a particularly preferred cable splice case employs all of them.

We prefer that the article be non-recoverable because much less power and also total energy are required of the electrical device. The reasons are as follows. Firstly, it is not then necessary to heat the article, instead only the sealing material needs to be heated. Secondly, the temperature to which the heater must rise is reduced from say 130° C. for shrinkage to say 90° C. for adhesive activation. Thirdly, means are avoided whereby the heater is caused or allowed to conform to an article whose size is changing.

We have found that an article having the features given above may be used to form a splice case for a telecommunications splice that requires for installation from, say, 20 watt hours for a small size to 150 watt hours for a large size. Comparative figures for a fully heat-shrinkable sleeve coated over its entire inner surface with a hot-melt adhesive would be from 30–300 watt hours. Power consumption is preferably 1000–2000 watts, more preferably 1000–1700 watts.

The device of the invention and the splice case referred to above have been designed in conjunction with each other and there is an interrelation between the features of the splice case and functioning of the electrical device. For example, the localization of the sealing material means that the device of the invention may be in tape form (a tape was mentioned above in conjunction with the idea of zones in the device), the lack of dimensional recovery means that the tape does not have to accommodate shrinkage and therefore that there is no consequential increase in current density as the tape is deformed, the low power requirement allows a narrow and thin tape to be powered from a convenient portable power supply, and the variation in thermal conductivity of different parts of the case and of the cables makes the regulatory properties of the tape highly desirable.

BRIEF DESCRIPTION OF THE DRAWINGS

The invention is further illustrated with reference to the accompanying drawings, in which.

DESCRIPTION OF THE PREFERRED EMBODIMENTS

Figure 1:
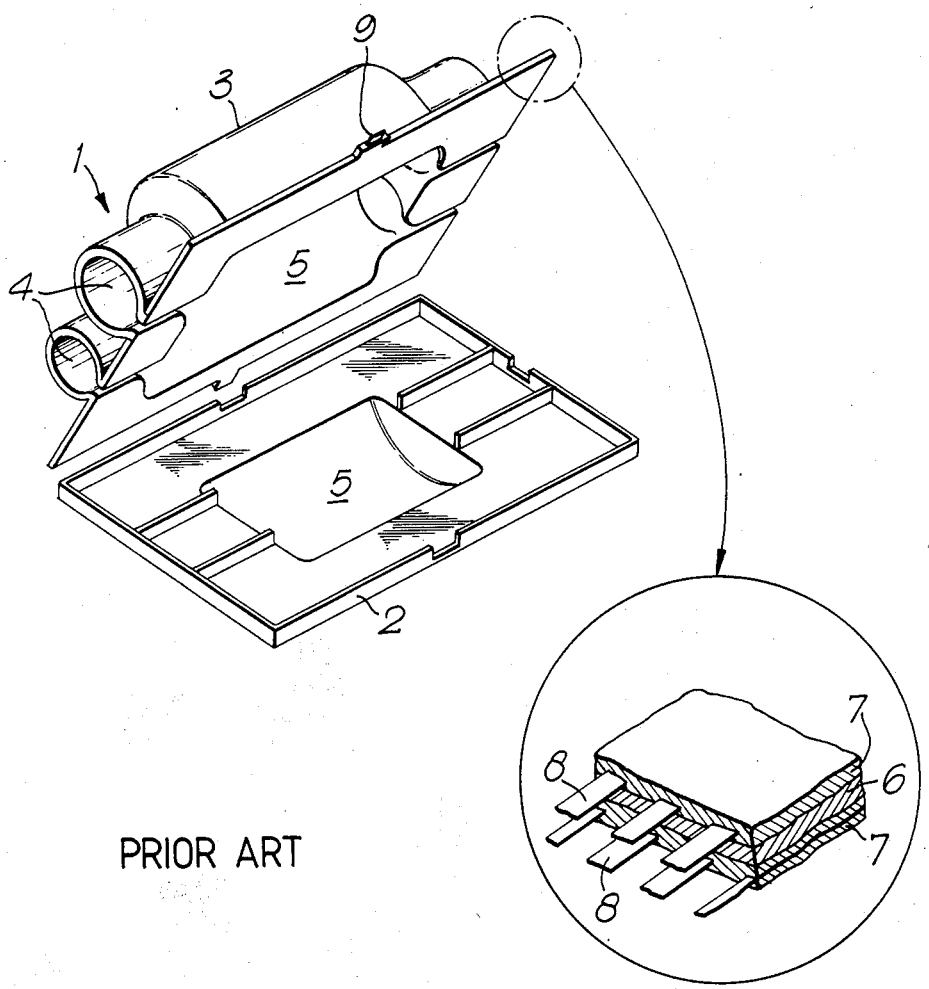
FIG. 1 shows a prior art telecommunications splice case employing a PTC conductive polymer heater.

FIG. 1 shows in perspective view a prior art telecommunications splice case 1, as disclosed in GB 1529353. The case comprises a rigid non-heat recoverable base 2 and a heat recoverable upper part 3. The base 2 and the upper part 3 are preformed to provide a central cavity 4 and outlets 5. A cable splice is encapsulated by the case 1, by closing together around it the base 2 and the upper part 3. Clamps (not shown) are then applied to hold the two parts together. The spliced cables would lie within the conduits 4 and the splice bundle within the cavity 5. The case illustrated has been designed for a splice between two pairs of cables, known as a 2 in :2 out configuration. It can be seen that a different case has to be designed for most splice configurations and also for widely differing cable sizes. In the cable accessories art it is important that inventories be kept low and therefore that any given product be applicable to as many cable sizes and splice configurations as possible.

The upper part 3 of splice case 1 is electrically heat-shrinkable. Thus when it is heated it will shrink to engage the spliced cables thereby sealing them. In particular, the conduits 4 are radially heat-shrinkable so that, after shrinkage, no leak paths exist between them and the cables passing therethrough. An adhesive, activatable by heat, may be applied around the inside of the conduits 4 to aid sealing to the ingoing and outgoing cables.

Heat for shrinkage and for adhesive activation is supplied by a self-contained electrical heater within the material of the upper part 3. This is shown in the inset. The heater is a conductive polymer heater employing a layer 6 of a PTC composition. Thus, the heater is self-regulating. A preferred form of heater employs the layers construction disclosed in U.S. Pat. No. 4,330,703. A PTC layer 6 is sandwiched between two constant wattage layers 7 which carry electrodes 8 by means of which the heater may be powered. The electrodes may be bussed to some suitable electrical connection 9.

We have found that it is difficult to achieve the electrical properties of such a heater that are desirable in the application illustrated. In particular, the power consumption is very high, requiring power supplies that are too heavy or large for use in the field, and current inrush is too large, requiring a more robust product than otherwise necessary or requiring a complex and expensive controlled power supply.

Figure 2:
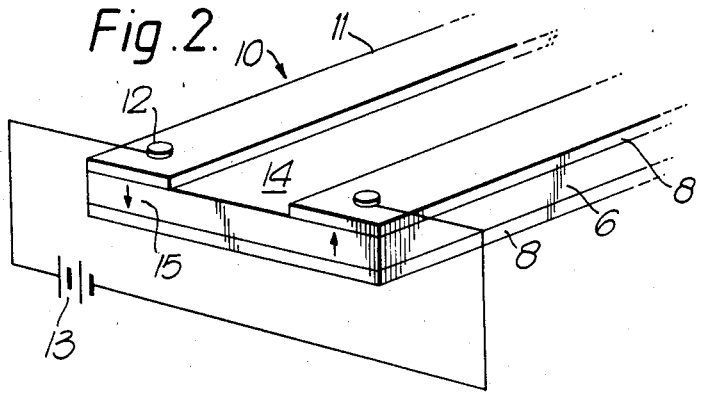
FIG. 2 shows in perspective a first embodiment of an electrical device of the invention suitable for use as a heater.

A first embodiment of the invention is shown in FIG. 2, which illustrates in perspective view an electrical device 10 in an elongate form, such as tape 11. It comprises a PTC composition 6 and electrodes 8 on either side of it and running lengthwise along the strip. Connections 12, for example rivets or staples, are provided for connection to a source of electrical power, for example a rechargeable battery.

The electrode 8 on one side of the PTC composition 6, on the top as illustrated, is routed at 14 or is provided in two parts with a gap 14 therebetween. The effect of the rout (or gap) 14 is to provide two zones within the device 10. In one zone, at the left of the Figure, the current flow as shown by the arrow 15 is vertically downwards, and on the right of the figure it is vertically upwards.

Current flows from one zone to the other horizontally across the lower, floating, electrode 8.

The device could be powered in other ways. For example, power could be applied between the lower electrodes and selected upper electrodes. Different upper electrodes could be brought into play at different times. Initially one upper electrode could be connected, then after say 0.5–3 minutes, especially about 1 minute, one or more others could be connected. This would reduce current inrush. Such switching could be accomplished at the power supply. The effect is that a first zone of the PTC material allows to reach substantially its switching temperature before a second zone is connected. The electrodes shown may be divided to provide more than two zones.

In the design illustrated the rivets or staples 12 must either be electrically insulating or must extend only partly into the composition 6. Conductive rivets or staples may, however be used if some insulation is provided. For example a rout may be made through the bottom electrode along its centre line, and the single rout in the top electrode replaced by two routs, one towards each edge.

The path through the PTC composition 6 taken by the current is preferably substantially vertical, as drawn, although there may be some generally horizontal current flow through the composition from one electrode to the other. Vertical current flow may be ensured by choice of the relative dimensions of the device, for example the separation between the two top electrodes, i.e. the width of the rout 14, may be much larger than the thickness of the PTC composition 6.

We prefer that the width of the rout is from 1–5, preferably 1–2, times the thickness of the PTC composition. The absolute size of the device 10 will of course depend on the job it is to do, but for adhesive activation in the cable accessories industry the PTC composition is preferably from 0.5–1 mm thick and from 20–150 mm, especially 25–100 mm wide. The rout is preferably 1 mm. The strip may be of any length and may be cut to the desired length in the filed.

A suitable material for the PTC composition comprises a crosslinked polyethylene containing from 20–50% of carbon black having a particle size of from 600–2000 angstroms, or a surface area 15–55 sqm per gram. The switching or anomaly temperature $T_s$ desirable will of course depend on the intended use of the device, but where it is to activate adhesive preferred for sealing cable splice cases, $T_s$ is preferably from 90°–130° C. Where the device is to be used to cause heat-recovery a value of $T_s$ of 130°–160° C. may be preferred. Much lower values may be chosen for other purposes such as trace heating etc.

The desired resistance of the composition will also depend on the intended use of the device and on the type of power supply that is available. If a conveniently portable power supply is to be used and if several devices are to be powered before recharging, a power consumption of 25–150 watt hours, especially 25–90 watt hours per heating is preferred. A convenient voltage is 12 or 24, preferably 24, and generally less than 50 volts. We therefore prefer the resistance of the device on initial connection of the power supply to be 0.25–2 ohms. For the preferred dimensions of the device, the composition should have a resistivity at 20° C. of from 2–20 ohm cm. An inrush current of up to about 50 amps, preferably up to about 35 amps will in general be acceptable.

The device may incorporate, instead of a simple PTC composition 6, a laminate or other combination of a PTC composition and one or more layers of a constant wattage composition. Also, or instead, one or more layers of an NTC composition may be used.

The device is preferably flexible for ease of use and this is one of the advantages of conductive polymer PTC compositions over, for example ceramic materials. Ceramic materials may however be preferred for some uses.

A sealant material, for example a heat-activable adhesive such as a hot-melt adhesive may be provided with or as part of the device. For example such a material could be laminated to one or both sides of the device or the device could be embedded within the material.

Where the device is to cause heat-recovery, it may be provided with or as part of a heat-recoverable article, in which case the device is preferably arranged so as not to impede recovery, or is itself able to be deformed as recovery progresses. One possibility, where it is used with a radially recoverable sleeve, is to provide devices of the invention running longitudinally along the sleeve so that they merely become closer together on recovery. A further possibility is for the device itself to be recoverable, in which case it may be used with another recoverable article or it may alone provide a sealing function. Here, the electrodes and the PTC composition will have to be able to change in shape or size and if sheet metal electrodes are used some means should be provided whereby they can collapse.

The invention can be seen to provide an electrical device comprising: a PTC or NTC material; at least two electrodes which can be connected to a source of electrical power to cause a current to pass through the material; and at least one floating electrode in electrical contact with the material. We prefer that the floating electrode is insulated such that an external source of electrical power cannot be connected to it.

Various more complex devices will now be described, and in each of them any one or more of the above features may be employed.

Figure 3:
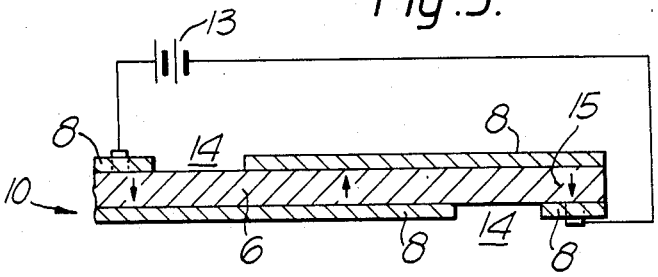
FIG. 3 is a transverse cross-section of a second embodiment of the invention.

FIG. 3 shows in transverse cross-section a device similar to that of FIG. 2, but having three rather than two zones. Again, the relative dimensions of the device may be chosen to ensure vertical current flow (as drawn) if that is what is desired. If the device were thicker and narrower, some diagonal current flow from the top left electrode to the bottom right electrode may occur. We have found, however, that for our preferred dimensions there is in general no diagonal flow.

Figure 4:
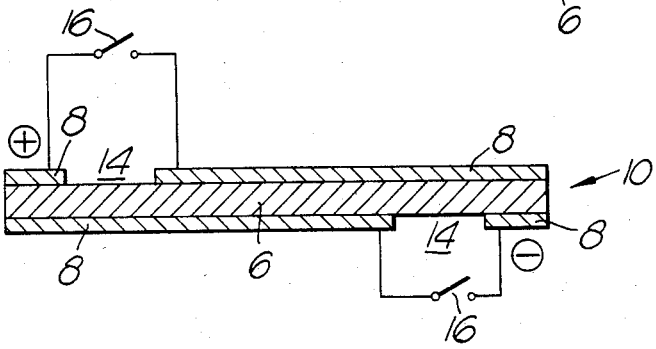
FIG. 4 shows a device similar to the second embodiment of the invention, but employing external switching.

FIG. 4 shows an embodiment of the invention where zones are provided whose interconnection can change with respect to the power supply between series and parallel. A consequence of this is that the direction of current flow in one of the zones changes by substantially 180° C., i.e. it reverses.

We prefer that such a device change from three or more zones (three as illustrated) in series on initial connection of a power source, i.e. when current in-rush may be a problem, to three or more zones in parallel at steady state operation.

This change preferably occurs automatically, more preferably on the device or its surroundings reaching a certain temperature or after expiry of a certain time or after a certain drop in current flow is registered. We prefer that the control mechanism be inherent in the construction of the device, but in addition or instead some other control means may be provided in thermal contact with the device or its surroundings or separate from the device.

For example external switches 16 may be provided that are manually operated by the user of the device. When the switches 16 are open, the three zones are in series. Thus the device may be connected to a source of electrical power as indicated by the + and − signs, and after a certain period of time, or when a certain amount of electrical heating has occurred the user may close the switches to cause connection of the three zones in parallel.

In this way, a current in-rush on initial connection is reduced due to the lengthy current path, three times the thickness of the composition 6; and a satisfactorily large steady state heat output is guaranteed by the short current path, a single thickness of the composition 6, of the parallel circuit.

As an alternative to simple manual operation of switches 16, they may be controlled by a clock, by means that senses the temperature of the device or its surroundings or by means that senses a drop in current through the device. Such means may be situated in, or adjacent the device, or where appropriate away from the device, for example within the power supply.

The design illustrated in FIG. 4 may be expected to reduce current in-rush at 24 volts from, say, 200 amps in the case of no routing to, say, less than 30 amps and often to about 10 amps. Such Figures may be achieved with a strip heater of 40 cm length, 3 cm width and 1 mm thickness.

Under unfavourable conditions however, a disadvantage may be noted with the embodiments of FIGS. 2–3. It is possible in some designs for the entire current flow to cease prematurely due to one of the zones becoming hotter than the others. The reason is simply that the zones are in series. This problem can be overcome by correct choice of the relative dimensions of the device to ensure that the current densities at the various parts of the device do not differ too widely. We prefer that the width of the edge zones (i.e. the width of the top left and bottom right electrode strips) are each from 25–400% of the width of the central zone (i.e. the width of overlap of the top right and bottom electrodes).

Figure 5A:
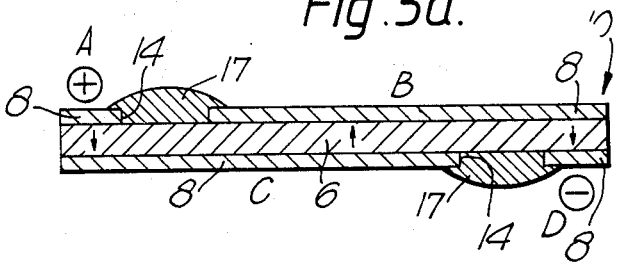
FIG. 5 shows a device similar to the first embodiment of the invention, but employing an integral shunt resistance.

FIG. 5*a* shows in transverse cross-section a particularly preferred embodiment of the invention. Here an electrical device 10 is preferably in strip form, and it preferably functions as an electrical heater. As before, the device comprises a PTC composition 6 and electrodes 8 on either side of it, optionally with intervening layers of other compositions such as constant wattage compositions. The electrodes are routed as shown at positions 14, or separate electrodes are used with spaces 14 between them.

The routs (or gaps) 14 are bridged by means 17. Means 17 may comprise a resistive composition that extends along, preferably continuously along, the routs 14. The means 17 may, however, comprise one or more discrete bridges from one part of the electrode to another part.

We prefer that the means 17 comprises a constant wattage composition, and that the device then functions as follows. When the device is first connected to a source of electrical power, as indicated by the + and − signs, it is at ambient temperature, say about 20° C., which is below the $T_s$ of the composition 6. The resistance of the composition 6 is then low, and the means 17 is chosen to have a resistance between that low resistance and the high temperature resistance of composition 6. Means 17 need not necessarily have a higher resistivity than composition 6 because the dimension of the rout may be, and generally will be, much greater than the thickness of composition 6. However, we prefer the means 17 to have a resistivity of 0.1–100, preferably 2–10 ohm cm, and the composition 6 to have a low temperature resistivity of 2–10 ohm cm. and a high temperature resistivity at about $T_s$ of $10^3$–$10^5$ ohm cm.

The initial flow of current is therefore as indicated by the arrows; since the means 17 has a resistance much higher than that of the composition 6 the electrical circuit may be considered analogous to that of FIG. 4 with the switches 16 open.

Heat is now generated within the device by $E^2/R$ heating, and the resistance of the composition 6 begins to increase as $T_s$ is approached. At $T_s$ its resistance is greater, preferably considerably greater, than the resistance provided by means 17. The circuit may now be considered to be analogous to that of FIG. 4 with the switches 16 closed. Thus, the three zones, initially connected together in series, automatically become connected together in parallel.

This embodiment may be altered by employing a composition having a negative coefficient of resistance (NTC) as means 17 instead of or in addition to a constant wattage composition. This may produce a sharper transition from series circuitry to parallel circuitry. Where an NTC material is used as means 17, a constant wattage composition may be used as composition 6 instead of a PTC material. Alternatively, means 17 may be PTC and composition 6 may be NTC if a change from parallel to series circuitry with increasing temperature is required (or vice versa).

Additional layers may be provided. For example an insulating layer for example of mylar may be provided over the external surfaces of electrodes, and constant wattage layers used between the composition 6 and each electrode 8. Such constant wattage layers are preferably 0.0001 to 0.01, especially about 0.008 cm thick, and preferably have a resistivity of 100–10000 especially about 1000 ohm cm. The electrodes preferably comprise aluminium, nickel or tin-plated copper foil, for example of thickness 0.001–0.02, especially about 0.0025–0.01 cm.

Figure 5B:
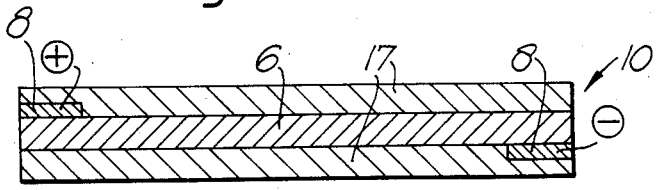

A further embodiment is shown in FIG. 5*b*. Here a PTC composition 6 is provided on opposing surfaces with electrodes 8 and with NTC compositions 17. When the device is cold, the resistance of the composition 6 is less than that of compositions 17, and the current therefore flows diagonally from the top left electrode to the bottom right electrode. When the device is hot, the resistance of the composition 6 has increased and that of compositions 17 has decreased. Now, compositions 17 and electrodes 8 act as electrodes extending across the entire top and bottom surfaces of the composition 6. Thus, current will then flow substantially vertically through composition 6. The effect is to reduce the length of current path as the device becomes hot.

Figure 6:
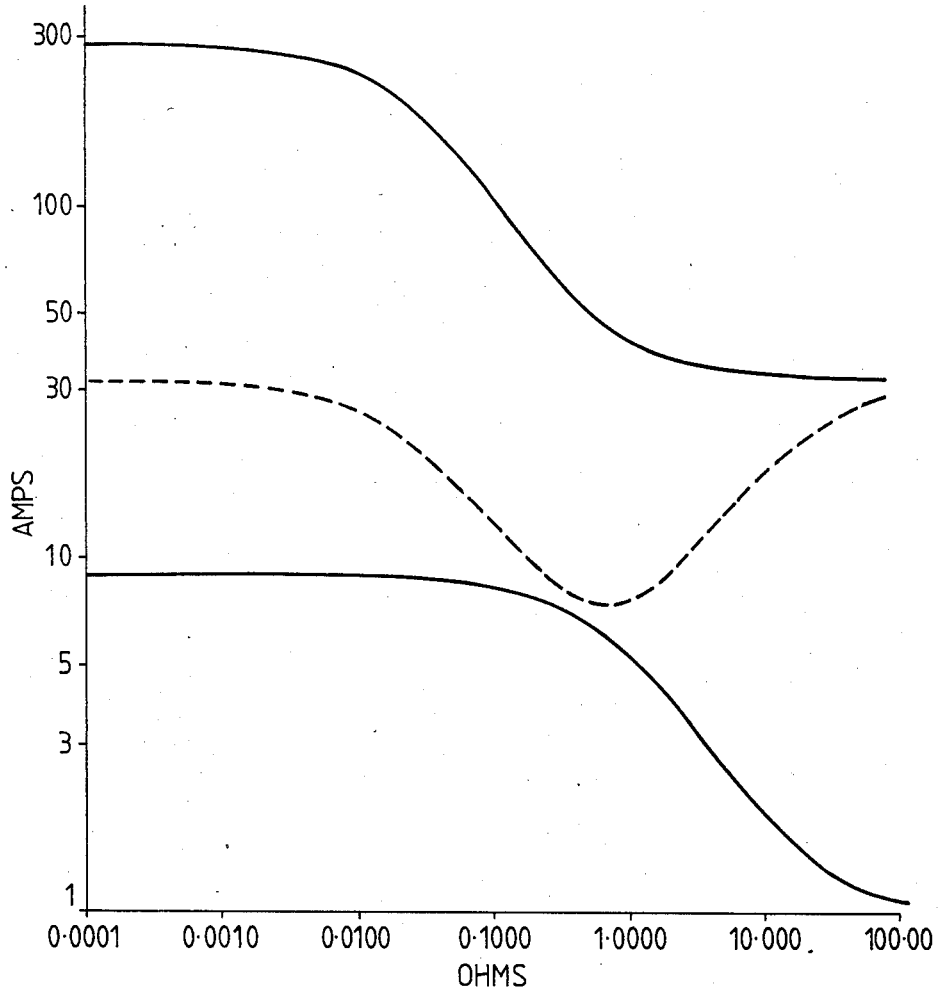
FIG. 6 is a graph showing current through the device of FIG. 5 varying with shunt resistance.

FIG. 6 is a graph that shows the effect of the resistance of the means 17 of FIG. 5*a* on the performance of that device. The top solid line on the graph shows the way in which the inrush current through the device varies with the resistance of means 17. The lower solid line shows the analogous variation in the steady state current, i.e. in the current drawn at $T_s$. It can be seen that the in-rush current falls with increasing resistance earlier than does the steady state current. The dotted line on the graph shows the ratio of the inrush current divided by the steady state current, using the numerical values of the current scale of the ordinate.

A resistance of slightly less than 1 ohm can be seen to provide the smallest value of the ratio of inrush current/steady state current, and a value from 0.1 ohm to 10 ohm provides a significant improvement over permanently open or closed circuits across the routs 14. The absolute values of course depend on the size and shape of the device and also on the materials used, but the principle is general, namely that inrush current can be reduced without a corresponding drop in steady state power. This is achieved without the need for any separate switching mechanism. We prefer that the inrush current is kept below 50 Amps, preferably below 45 Amps.

Figure 7:
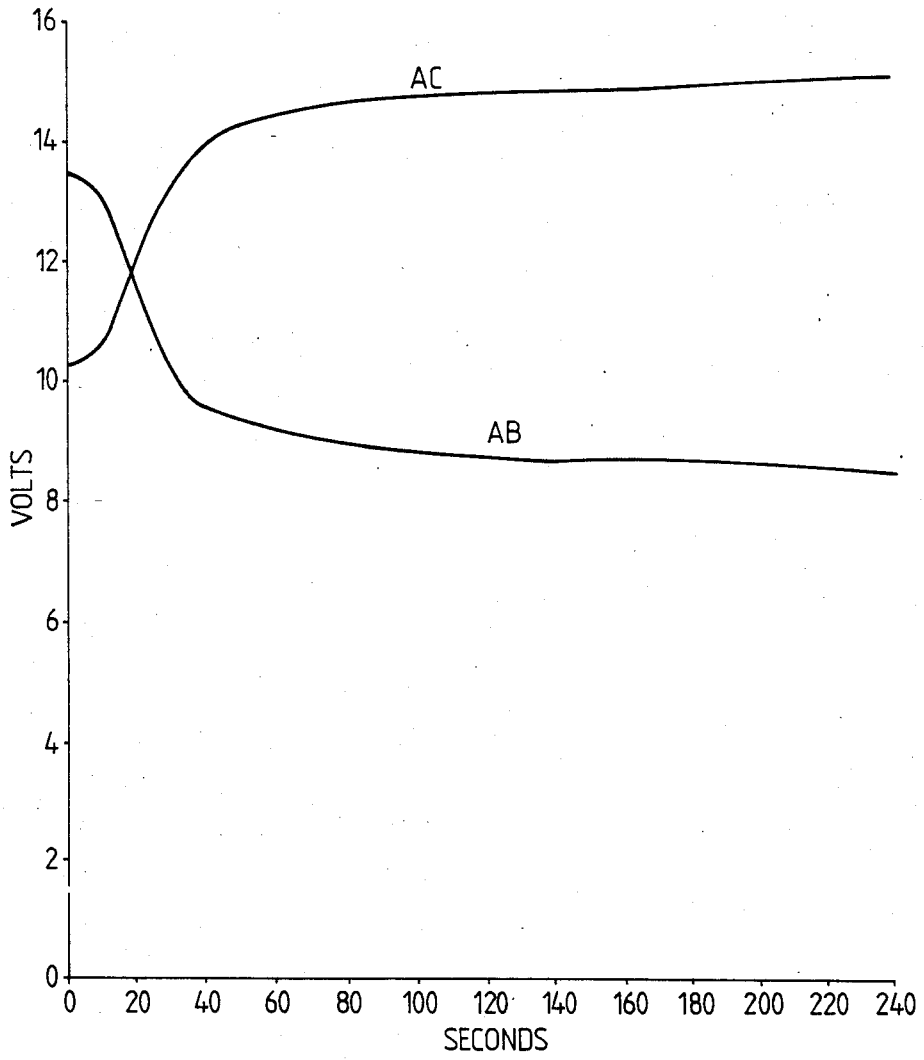
FIG. 7 is a graph showing voltage variation with time in the device of FIG. 5.

The graph of FIG. 7 shows the voltage drop between electrode regions A and C and between regions A and B of the device of FIG. 5*a*, as a function of time after applying 24 volts between regions A and D. Initially, there is a voltage drop from A to B of about 10.5 volts.

One could consider the voltage at A as being 24, at B 10.5, at C 13.5 and at D 0. Thus the current flow in the edge zones is vertically downwards as indicated by the arrows, and in the centre zone is vertically upwards as indicated by the centre arrow.

As time progresses, the device becomes hot through $E^2/R$ heating, and the value of R of the composition 6 increases. As can be seen from the graph, the potential drop from A to B falls, and that from A to C increases. After about 20 seconds the two potential drops are equal, and therefore electrode portions B and C are at the same potential, namely 12 volts. Thus, at this stage no current flows in the central zone of the conductive polymer.

The central zone may then cool slightly due to the lack of current, but in most cases its temperature will continue to rise due to conduction of heat from the edge zones which are still being heated.

The potential difference between A and C continues to rise rapidly and that between A and B continues to fall rapidly until about 60 seconds after start-up. Current now flows vertically downwards in the central zone because electrode portion C is at the higher potential. The three zones are now in parallel, and the current direction in the centre zone has reversed. When the device is in a steady state the potential drop will be substantially 8 volts in the centre zone and 16 volts in each edge zone.

The three zones may be substantially equal in size. If desired, however, they can differ, for example in width and thickness. One reason for choosing different sizes is to alter the current densities or voltage drops per cm in the zones. It is generally desirable that all zones be at substantially the same temperature and if there is a tendency for different temperatures to occur in practice (for example the outer zones may be less well thermally insulated) the effect may be corrected by means of a higher current density in those zones.

The embodiment of FIG. 5*a* may be varied slightly by the provision of more than 3 zones. For example four zones may be provided by means of two routs in an electrode one side of the composition 6 running near its edges, and one rout in an electrode on the other side of the composition running along its centre. The reader will be able to design analogous devices with five or more zones.

Figure 8:
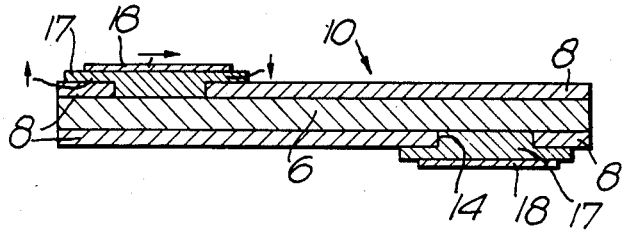
FIGS. 8–11 show other ways in which a shunt resistance may be provided.
Figure 9:
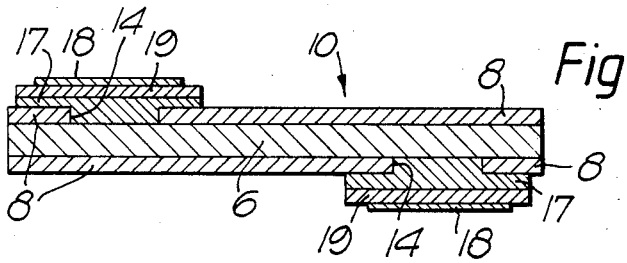

The device illustrated in FIGS. 8 and 9 are variations of the device illustrated in FIG. 5*a*. In FIG. 8 a conductive layer, for example an aluminium film or copper film (which allows a lower contact resistance) is provided over the constant wattage composition 17. In FIG. 9 a layer 19 is additionally used. The layer 19 is of a constant wattage composition, generally of lower resistivity than that of composition 17.

The purpose of the variations of FIGS. 8 and 9 is as follows. For many uses the constant wattage composition of FIG. 5 must be of a resistivity of for example 0.1–100 especially about 2–10 ohm cm and if that is to be provided by a carbon loaded polymer it will require much carbon and thus be difficult to bond to the electrodes. In FIG. 8 a much higher resistivity composition 17 is used, for example 100–10000, especially 500–2000 ohm cm.

This is easily bonded to the electrode. The higher resistivity may be compensated for by a smaller thickness and by a larger area. A layer of aluminium 18 can complete the current path as indicated by the arrows.

In order to avoid any risk of direct contact between layer 18 and electrode 8, additional layers may be provided. For example the electrode 8 may be covered by an insulating layer, except perhaps where electrical connection to a means 14 is required. We prefer however that, as illustrated in FIG. 9, layer 19 of resistivity 0.1 to 100 especially 2 to 75 ohm cm be provided as a spacer. A principal advantage of layers 18 and 19 is that they will dissipate heat generated in composition 17, and a higher heat output may be sustained.

Figure 10:
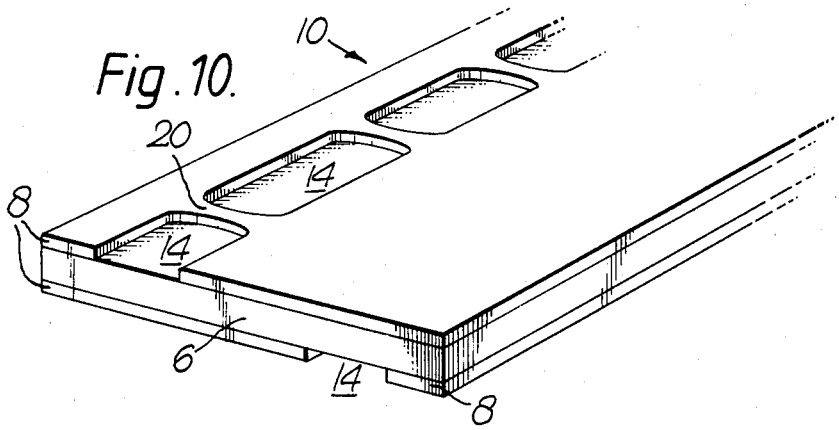
Figure 11:
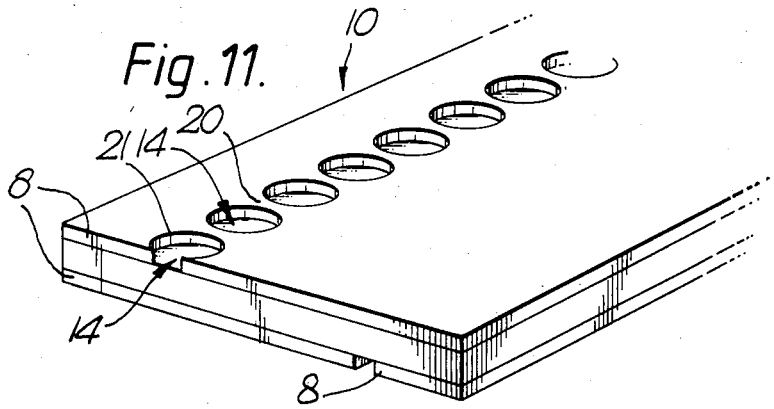

FIGS. 10 and 11 show alternative electrode designs. Instead of the bridge of composition 17 shown in FIG. 5*a*, the electrodes are incompletely routed to provide bridges 20 of electrode material. Strictly speaking, these designs will preferably be produced by stamping etc. rather than routing. In the design of FIG. 10 electrode bridges 20 may occur infrequently along the length of the strip. The strip may be for example 3 cm wide and the composition 6 1 mm thick, in which case the rout 14 would be about 2 mm wide and the bridge 20 about 3 mm long. We prefer that the power is connected to a point at least 15 cms, preferably at least 20 cms from a bridge.

Figure 12:
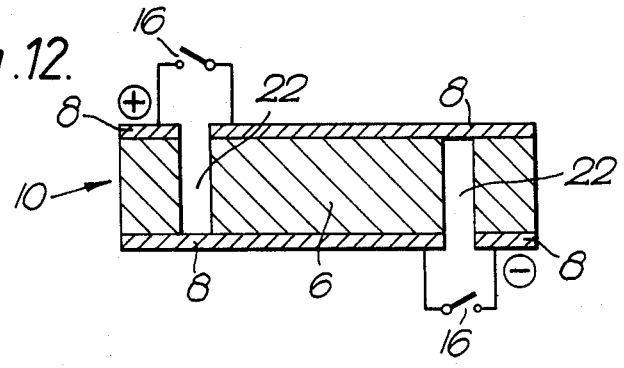
FIGS. 12 and 13 show further embodiments of the invention.

The design of FIG. 11 is similar except the electrodes 8 are perforated with lines of holes 21. Since there are many such holes each bridge 20 would be smaller than that of FIG. 10. An advantage of the design of FIG. 11 over that of FIG. 10 is that the strip may be cut to length in the field in the way that the devices of FIG. 5 can be cut.

Where diagonal current flow within a device of the type of FIG. 5a is not desired, the routing may extend deeper than the electrodes 8. It may extend all or part of the way into the composition 6. In the device illustrated in FIG. 12 the routs 22 extend all the way through the composition 6. The device of this Figure may of course be manufactured by separate provision of the three zones, rather than by subsequent routing of a single block of composition 6.

Switches 16 may be provided to cause a change of circuitry between series and parallel.

Figure 13:
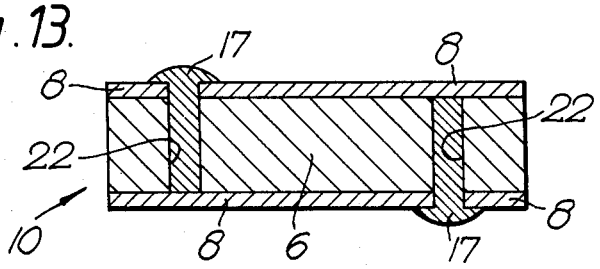

In FIG. 13 the routs 22 are filled with a constant wattage material 17. If desired, the material may be localized at the electrodes. It may, alternatively, be desirable to fill the routs 22 of FIG. 12 with a non-electrically conductive material, to provide heat transfer between the zones.

Figure 14:
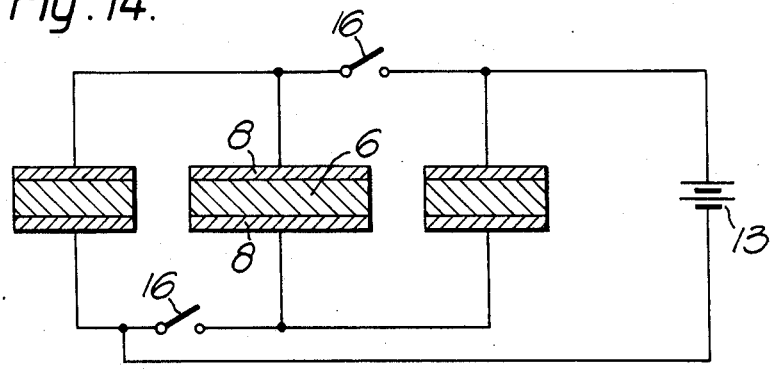
FIG. 14 shows a device of the invention where various separated zones are provided.

The various zones may, in fact be physically separated and interconnected only electrically. This is illustrated in FIG. 14.

Figure 15:
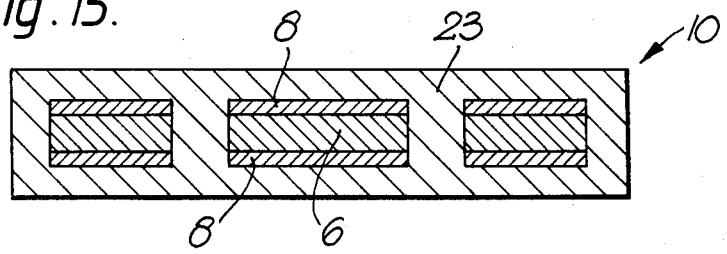
FIG. 15 shows various zones of a device in a common heat-conductive material.

In FIG. 15, which omits the electrical interconnections, the zones are physically separated but embedded in a material 23. The function of material 23 may be simply to hold the zones as a single structure, to provide heat transfer between them, or it may comprise a hot melt adhesive or recoverable material that it is the function of the device 10 to heat.

Figure 16:
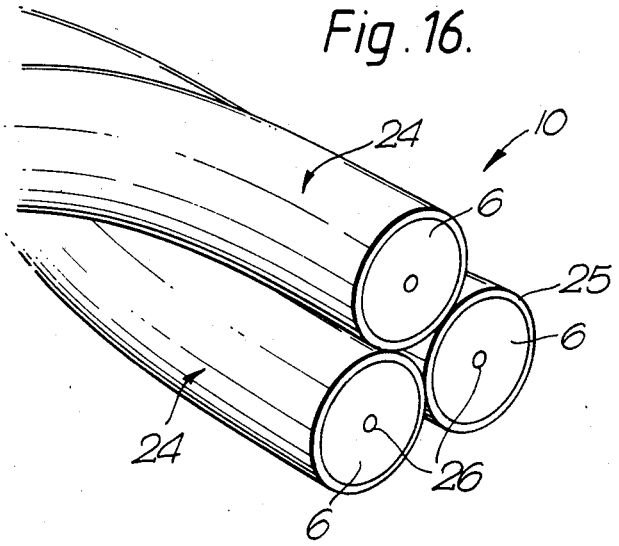
FIG. 16 shows a device of the invention where various zones are provided as co-axial heaters.

In FIG. 16 a device 10 is ilustrated that comprises three zones each comprising a coaxial cable 24. Each cable 24 has an outer conductor 25, and an inner conductor 26 and a PTC composition 6 therebetween. The cables may be separated, but we prefer that they are at least in thermal contact with one another, for example by twisting together. The electrical connection between the zones may be equivalent, for example, to that shown in FIG. 4 where external switching is employed.

Figure 17:
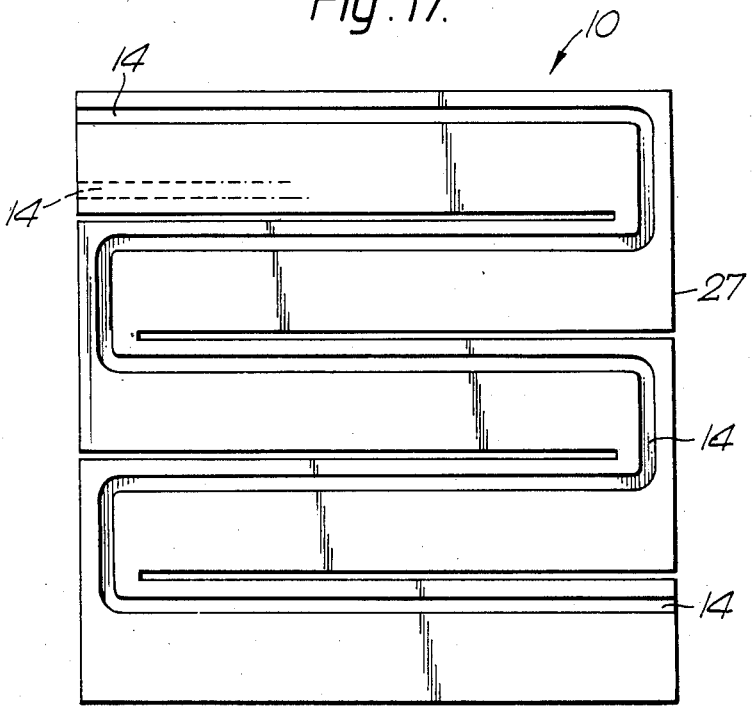
FIGS. 17 and 18 show ways in which sheet, rather than tape devices may be constructed.
Figure 18A:
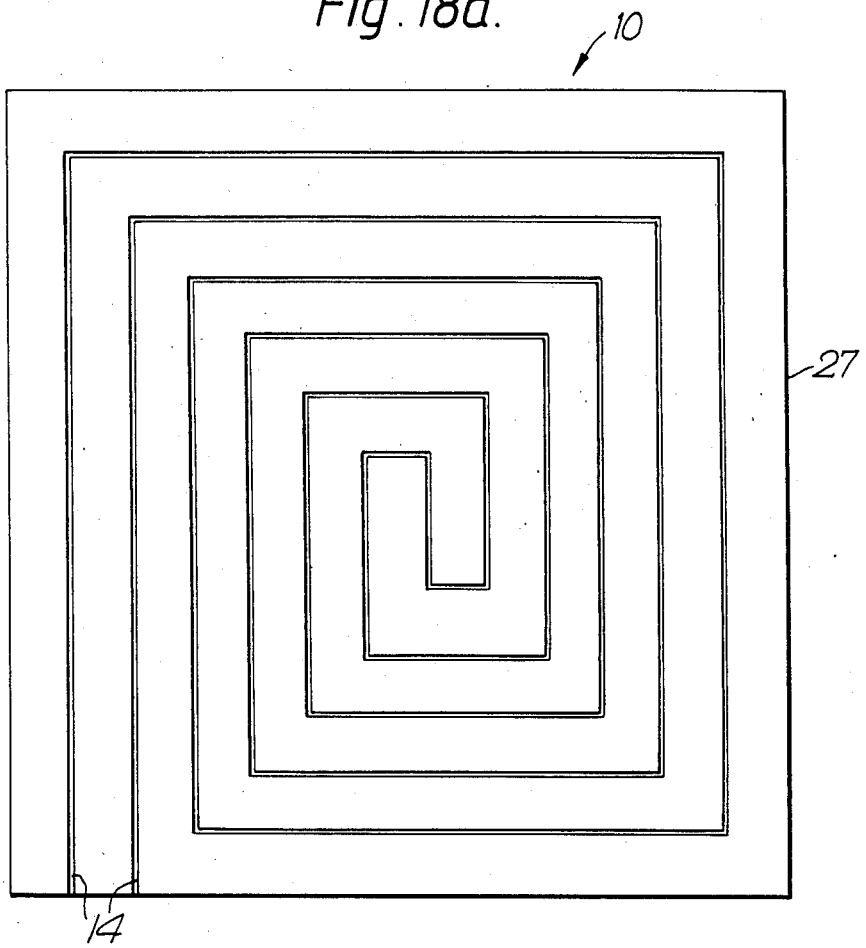
Figure 18B:
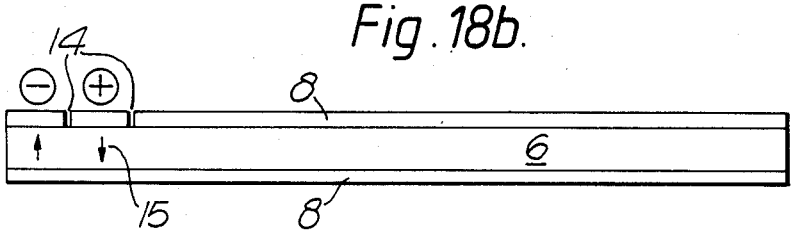

FIGS. 17 and 18 show two ways in which devices in sheet, rather than tape, form may be constructed. In FIG. 17 a top and bottom electrode are each routed as shown at 14 (the rout 14 on the underside of the sheet is partially shown and by dotted lines). The routing follows a serpentine pattern and the device is electrically similar to that of FIG. 3. The device of FIG. 18 is electrically similar to that of FIG. 2.

FIG. 19 shows an article 28 particularly useful as a cable splice case, especially a telecommunications cable splice case. Cables 29 are shown spliced together at a splice bundle 30 of diameter somewhat larger than that of the cables. The splice illustrated is a branch joint of 1 in : 2 out configuration.

The splice case 28 comprises a cover 31 in the form of a flexible sheet, in generally sheet form that can be folded over or wrapped around the splice bundle 30 and part of the cables 29. The purpose of the splice case 28 is to provide an environmental seal, especially against moisture, around the splice thereby effectively replacing the cable jackets that were removed in order to splice together the conductors of the cables 29. We prefer therefore that the cover 31 comprises an impervious material. An aluminium or other metal film may be employed, preferably laminated to a plastics film further to reduce moisture transmission. The cover may be reinforced for example with fibres such as glass fibres. The cover may comprise a fabric that has been rendered impervious.

The cover 31 may contain a sealing material over its entire surface, but in the case of a heat-activatable sealing material this would require a large power input for installation. We therefore prefer a sealing material to be provided (or at least only to be activated) where it is required, for example around the edges as shown by the region 32. Thus, sealing material is activated between the cover 31 and the cables 29, and between layers of the cover where otherwise a leak path would exist. It is not generally necessary to employ a sealing material along the fold line at the back of the cover as illustrated.

An electrical device of the invention (preferably less than 1.5 mm, especially less than 1 mm thick, to ensure flexibility) is provided around the edge region 32, and leads 33 may be provided to connect it to a source of electrical power. The device preferably has a heating capacity at steady state of 0.5 to 1.4 Watts per square cm, and less than 2.5 Watts per square cm at inrush. The device is preferably self regulating (or is externally regulated) at 100° to 140° C., preferably 115° to 130° C.

The cover 31 is folded or wrapped around the cable splice and preferably then, at least temporarily, held in the folded or wrapped configuration by some means such as mechanical clamps which hold the then top and bottom layers together along the edge region 32 and preferably between the branching cables at the right hand side of the splice.

The next step is to activate the sealing material and to ensure that it fills any voids between the cover and the cables or between overlying layers of the cover. For example there may be tent shaped voids at each side of each cable as the two layers of cover part in order to pass over and under the cables.

Figure 19A:
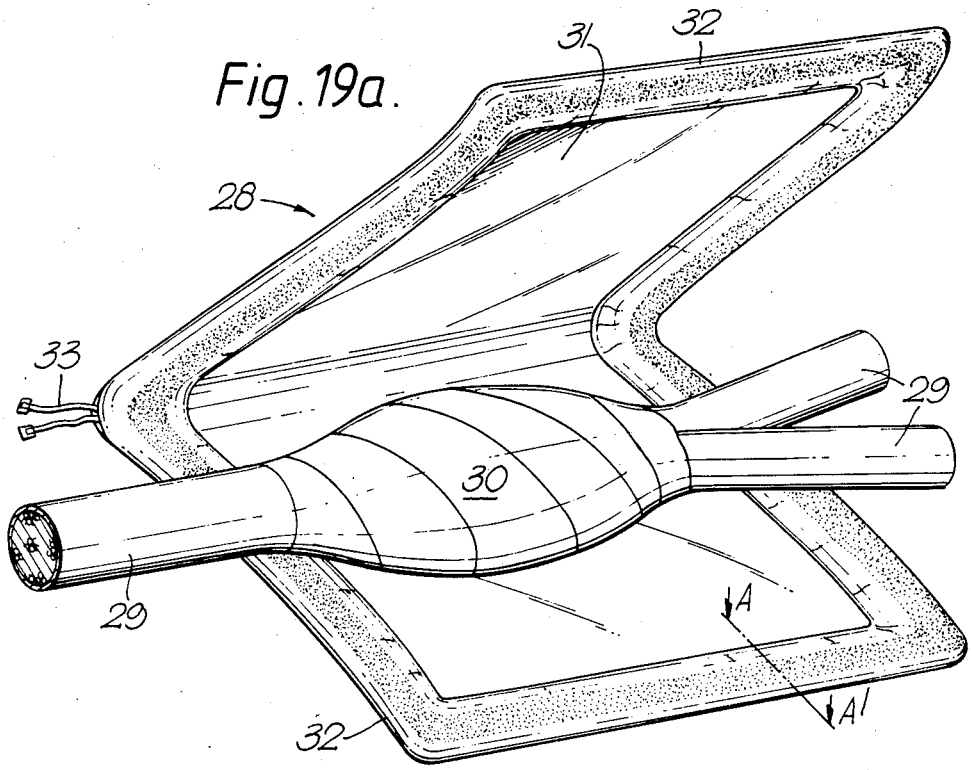
FIG. 19 shows a telecommunications splice case employing a device of the invention.
Figure 19B:
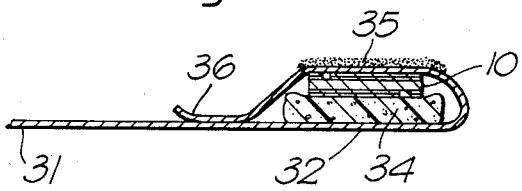

One way such voids may be filled may be understood with reference to FIG. 19*b* which is a cross-section along the line AA' of FIG. 19*a*. At the edge region 32, means 34, for example a resiliently compressible foam strip or inflatable bladder, is provided which is deformed when the clamps are applied to hold the cover in position around the splice. The heater 10 is then powered which causes the adhesive 35 to become hot and to soften or melt. When the adhesive is soft or molten it is able to deform or to flow and it does so under the driving force of the foam 34 which is now able to relax. Thus, the adhesive is forced to fill any voids that would provide leak paths into the splice case.

The splice case cover 31 is preferably not heat recoverable since it is desirable that the power requirement be kept to a minimum. In some situation, however, it may be recoverable preferably in a direction generally perpendicular to the cables. Such recoverability will tend to enhance the seal between the cover and the cables and may act to deform or displace the adhesive as desired.

Telecommunications splice cases may be pressurized in order to reduce moisture ingress and to provide a means of leak detection. In this case, the edge regions 32 of the cover may be designed to provide a pressure retaining seal. For example they may have a re-entrant or generally V-shaped (which includes U and similar shapes) cross-section in order that a bond between the top and bottom layers of the cover is not put into peel by the internal pressure. This may be achieved by overlapping the edge regions 32 as illustrated in FIG. 19*b*. The extreme edge 36 should not be bonded to the underlying layer since it is desirable that the internal pressure acts on each side of edge 36. In this way there is no excess pressure acting between edge 36 and the corresponding edge of the top layer of cover 31 that is bonded to it by the adhesive 35.

The electrical device 10 for use as a heater in the splice case 28 of FIG. 19 need not be provided around the entire edge regions 32 as illustrated in that Figure. It may instead be provided only half the way around, as shown in FIG. 20.

Figure 20:
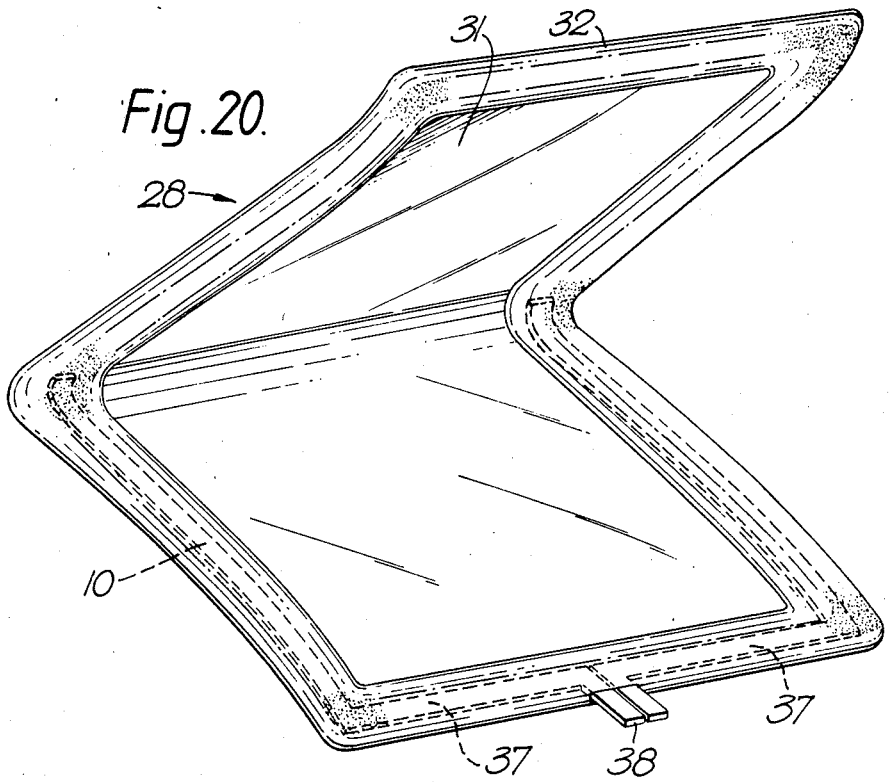
FIGS. 20–22 show embodiments of the device of the invention suitable for use in the splice case of FIG. 19.

In the embodiment of FIG. 20, two devices 31 of substantially L-shape are provided. They may have a tag 38 for electrical connection. The heater may be thicker along the longitudinal edges (indicated as 36) than along the transverse edges since generally only the transverse edges will need to bend, i.e. around the cables to be sealed. Thus the metal electrodes of the heater may be thicker there for example 50–200 microns, especially about 100 microns. We prefer from 50–100, especially about 75 microns for the transverse edges.

Figure 21A:
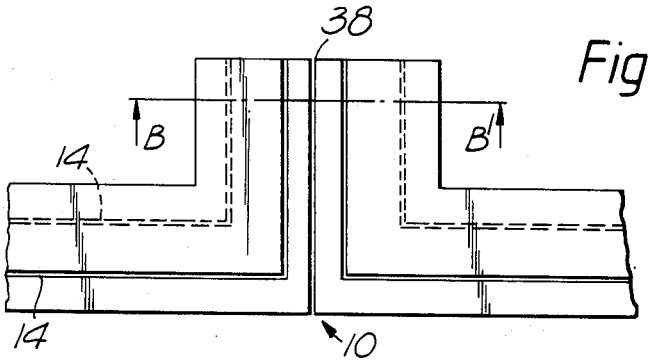

The three parts of FIG. 21 show ways in which the tag 38 (or other adjacent parts) of two devices 10 may be powered. Each device 10 may be routed and provided with a constant wattage composition 17 as shown in FIG. 5*a*, although other designs may be used. In FIG. 21*a* the dotted rout 14 is on the underside of the device 10 as drawn.

Figure 21B:
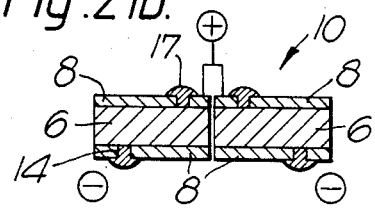

FIG. 21*b* is a cross-section taken along the line BB' of FIG. 21*a*. The two devices need not be insulated from one another. A disadvantage, however, is that the two devices are not identical (they are mirror images) and manufacture of two devices may be more expensive than that of one.

Figure 21C:
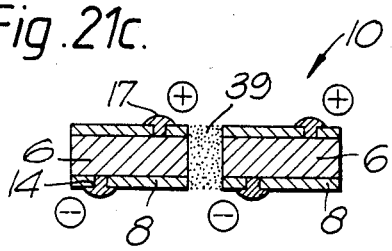

In FIG. 21*c*, the two devices 10 may be identical, and here some insulation 39 will in general be required between them.

Figure 22A:
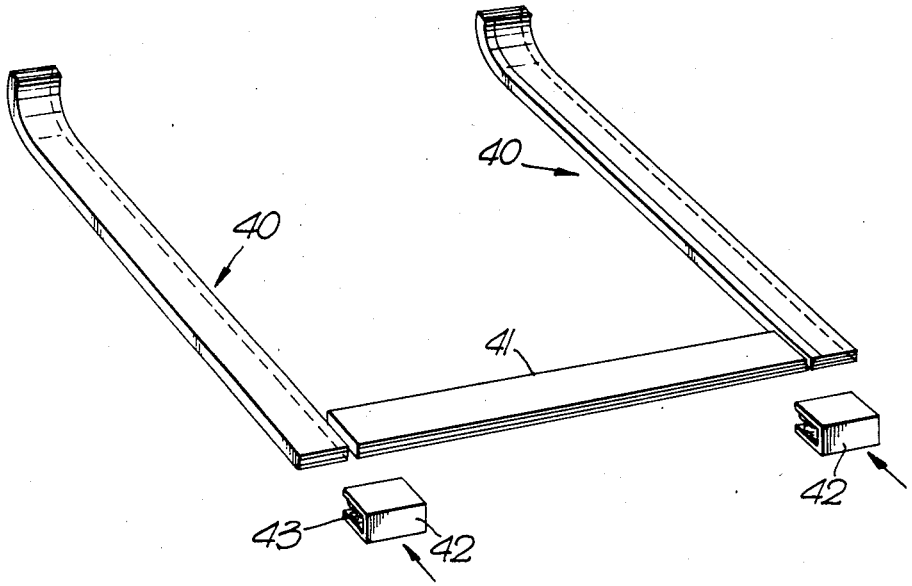

A possible disadvantage of the devices shown in FIG. 21 is that they are angular, and it may be difficult or expensive to provide lamination of electrodes and routing in an L-shape. FIG. 22 shows how this problem can be avoided. Here an L-shape (or other angular shape) is produced in two or more parts. The device 10 comprises a routed part 40 and a non-routed part 41. These two parts are joined together electrically by suitable means such as a spring or other clip 42, or by separate electrical bridges for the top and bottom electrodes. The clip preferably comprises a body of insulating material and electrically conductive contacts 43 which contact only the parts of electrodes they are intended to connect. An adhesive for example a part of the adhesive used to seal the splice case, could function at least partly to hold the clips in place.

Figure 22B:
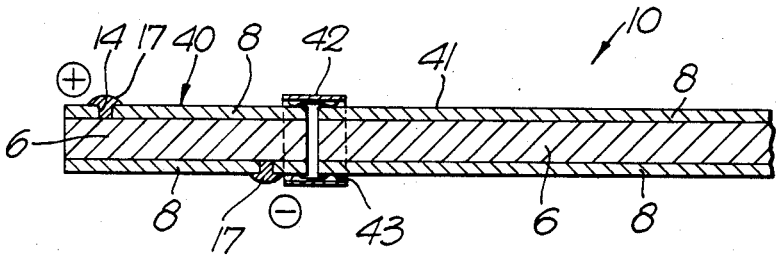

It can be seen from FIG. 22*b* that the constant wattage composition 17 bridging the rout adjacent the positive electrode serves also with respect to the non-routed section 41. In fact, the non-routed section will in general act merely as an extension to the right hand zone as drawn of the routed section 40.

If each routed section 40 is powered, then only one clip 42 will be necessary.

Both clips may however be employed, in which case it may be desirable to apply the power for example between the top left electrode of the left hand section 40 (marked, +) and the bottom right electrode of the right hand section 40. This would result in the three sections acting as a single electrical device of five zones. The heating effect in each section 40 would, however, be reduced since there is a smaller voltage applied to it.

For the avoidance of doubt it is here stated that the invention provides electrical devices embodying concepts for altering the way in which an electrical variable varies with temperature that may incorporate any one or more of the features disclosed herein. For example, any one or more of the ceramic or conductive polymer compositions, electrode configurations, device shapes, resistivities, switching mechanisms or ancilliary components may be selected. The invention also provides the use of any such device for environmental sealing with any of the features, for example flexible sheet, adhesive or adhesive displacing means, disclosed herein.

We claim:

1. An electrical device which comprises:
(a) a material comprising a PTC or NTC composition;
(b) at least two electrodes to which a source of electrical power may be applied to cause current to flow through the material; and
(c) means other than reversal of polarity of the source of power whereby a direction of current flow in a region of the material may be made to alter through at least 90°.

2. An electrical device which comprises:
(a) a material comprising a PTC or NTC composition;
(b) at least two electrodes to which a source of electrical power may be applied to cause current to flow through the material; and
(c) means whereby a current path length through the material may be reduced as the temperature of the device increases.

3. An electrical device which comprises:
(a) a material comprising a PTC or NTC composition;
(b) at least two electrodes to which a source of electrical power may be applied to cause current to flow through the material;
(c) at least two zones through which current may pass; and
(d) means whereby interconnection of the zones with respect to the source of electrical power may be altered between series and parallel.

4. An electrical device which comprises:
(a) a material comprising a PTC composition in at least two zones;
(b) at least two electrodes to which a source of electrical power may be applied to cause current to flow through the device; and
(c) a constant wattage composition interconnecting the two zones, the resistance of the constant wattage composition being from 0.1 to 10.0 times the geometric mean of the high and low resistance of the PTC composition.

5. An electrical device, which comprises:
(a) a material comprising a PTC or NTC composition; and
(b) first, second and third electrodes arranged such that application of a source of electrical power to the first and third electrode causes current to flow from the first electrode through the material to the second electrode and from the second electrode through the material to the third electrode;
the second electrode having a first surface adjacent the first electrode and a second surface adjacent the third electrode and an electrical connection between them, the first and second surfaces being of a size such that the maximum current density through the material via the second electrode is less than that for a direct passage between the first and second electrodes.

6. An electrical device which comprises:
(a) a strip of material comprising a PTC or NTC composition;
(b) at least one elongate electrode in sheet form in electrical contact with and running along one side of the material;
(c) at least two further elongate electrodes in electrical contact with and running along the other side of the material.

7. A device according to claim 6 in which said two further electrodes are separated by a distance greater than twice the thickness of the material.

8. A device according to claim 6, which additionally comprises means for electrically connecting together said two further electrodes.

9. An electrical device which comprises:
(a) at least two terminal electrodes which can be connected directly to a power source;
(b) at least two intermediate electrodes which, when the two terminal electrodes are first connected to a power source, are at intermediate potentials; and
(c) at least one PTC or NTC element through which, when the two terminal electrodes are connected to a power source, current passes in one direction when the device is at one temperature and in a substantially different direction when the device is at a different temperature.

10. An electrical device comprising: a PTC or NTC material; at least two electrodes which can be connected to a source of electrical power to cause a current to pass through the material; and at least one floating electrode in electrical contact with the material, and which is insulated such that an external source of electrical power cannot be connected to it.

11. An assembly comprising a device according to claim 1, and a heat-activatable adhesive that can be activated by said device.

12. An assembly comprising a device according to claim 1, and a heat-recoverable article that can be recovered by said device.

13. An assembly for forming a cable splice case that includes a device according to claim 1.

14. An assembly comprising a device according to claim 6 and a heat activatable adhesive that can be activated by said device.

15. An assembly comprising a device according to claim 6, and a heat recoverable article that can be recovered by said device.

16. An assembly for forming a cable splice case that includes a device according to claim 6.

* * * * *